US010352283B2

(12) United States Patent
Tavani et al.

(10) Patent No.: US 10,352,283 B2
(45) Date of Patent: Jul. 16, 2019

(54) INTERNAL COMBUSTION ENGINE FUEL, PREFERABLY DIESEL FUEL, FEED PUMP ASSEMBLY

(71) Applicant: Robert Bosch GmbH, Stuttgart (DE)

(72) Inventors: Manuel Tavani, Bitritto (IT); Rocco Guarino, Modugno (IT); Fabio Damiani, Modugno (IT)

(73) Assignee: Robert Bosch GmbH, Stuttgart (DE)

( * ) Notice: Subject to any disclaimer, the term of this patent is extended or adjusted under 35 U.S.C. 154(b) by 60 days.

(21) Appl. No.: 14/903,865

(22) PCT Filed: Jul. 8, 2014

(86) PCT No.: PCT/EP2014/064643

§ 371 (c)(1),
(2) Date: Jan. 8, 2016

(87) PCT Pub. No.: WO2015/004151

PCT Pub. Date: Jan. 15, 2015

(65) Prior Publication Data

US 2016/0146170 A1 May 26, 2016

(30) Foreign Application Priority Data

Jul. 10, 2013 (IT) ..... MI2013A001164

(51) Int. Cl.
*F02M 59/46* (2006.01)
*F02M 59/06* (2006.01)
(Continued)

(52) U.S. Cl.
CPC ..... *F02M 59/46* (2013.01); *F02M 59/06* (2013.01); *F02M 59/102* (2013.01);
(Continued)

(58) Field of Classification Search
CPC ..... F02M 59/04; F02M 59/06; F02M 59/102; F02M 59/442; F02M 59/46;
(Continued)

(56) References Cited

U.S. PATENT DOCUMENTS 6,663,027 B2 * 12/2003 Jameson ..... F02M 57/023 239/102.1
6,857,263 B2 * 2/2005 Gray, Jr. ..... F01N 3/035 123/698
(Continued)

FOREIGN PATENT DOCUMENTS

DE 102004027825 9/2005
DE 102005026511 12/2006
(Continued)

OTHER PUBLICATIONS

International Search Report for Application No. PCT/EP2014/064643 dated Sep. 1, 2014 (3 pages).

*Primary Examiner* — Patrick Hamo
*Assistant Examiner* — Joseph S. Herrmann
(74) *Attorney, Agent, or Firm* — Michael Best & Friedrich LLP

(57) ABSTRACT

Internal combustion engine fuel, preferably diesel fuel, feed pump assembly, the pump assembly (1) comprising a pump body (2); at least one cylinder (6) formed in the pump body (2) and extending along an axis (A2); a seat (12) formed in the pump body (2), at one end of the cylinder (6); an intake valve (18) for selectively controlling fuel feed into the cylinder (6), which is housed inside the seat (12) and in turn comprises a valve body (25); and an annular seal (26) extending around the axis (A2) and fitted inside the seat (12) between the valve body (25) and the pump body (2); the pump assembly (1) being characterized in that the valve body (25) is positioned contacting the annular seal (26) along a contact surface (45) of the valve body (25) and close
(Continued)

to a surface portion adjacent to a radially inner peripheral edge (46) of the seal (26); the valve body (25) having an annular step (48) along another surface portion adjacent to a radially outer peripheral edge (52) of the seal (26).

10 Claims, 2 Drawing Sheets

(51) Int. Cl.
*F02M 59/10* (2006.01)
*F02M 59/44* (2006.01)
*F04B 1/04* (2006.01)
*F04B 53/10* (2006.01)

(52) U.S. Cl.
CPC ..... *F02M 59/442* (2013.01); *F02M 59/464* (2013.01); *F04B 1/0452* (2013.01); *F04B 1/0456* (2013.01); *F04B 53/1025* (2013.01); *F04B 53/1087* (2013.01)

(58) Field of Classification Search
CPC ..... F02M 59/464; F02M 21/0245; F04B 1/0452; F04B 1/0456; F04B 53/1025; F04B 53/1087
See application file for complete search history.

(56) References Cited

U.S. PATENT DOCUMENTS

| | | | | |
|---|---|---|---|---|
| 9,435,306 | B2 * | 9/2016 | Aoki | F02M 59/102 |
| 2008/0240952 | A1 * | 10/2008 | Rodriguez-Amaya | F02M 59/464 417/499 |
| 2015/0017035 | A1 * | 1/2015 | McCrindle | F02M 59/102 417/434 |

FOREIGN PATENT DOCUMENTS

| | | | | |
|---|---|---|---|---|
| DE | 102008001890 | A1 * | 11/2009 | F02M 59/06 |
| DE | 102008042617 | * | 4/2010 | F02M 59/44 |
| DE | 102009001560 | | 9/2010 | |
| DE | 102010031600 | | 1/2012 | |
| DE | 102010039210 | | 2/2012 | |
| JP | 3594964 | B2 | 12/2004 | |
| JP | 2008157252 | A | 7/2008 | |
| JP | 2012229673 | A | 11/2012 | |
| WO | 2012163576 | | 12/2012 | |

* cited by examiner

INTERNAL COMBUSTION ENGINE FUEL, PREFERABLY DIESEL FUEL, FEED PUMP ASSEMBLY

BACKGROUND OF THE INVENTION

The present invention relates to an internal combustion engine fuel, preferably diesel fuel, feed pump assembly.

In particular, the present invention relates to an internal combustion engine fuel, preferably diesel fuel, feed pump assembly, said pump assembly comprising a pump body; at least one cylinder formed in the pump body and extending along an axis; a seat formed in the pump body, at one end of the cylinder; an intake valve for selectively controlling fuel feed into the cylinder, which is housed inside the seat and in turn comprises a valve body; and an annular seal extending around the axis and fitted inside the seat between the valve body and the pump body.

The known pump assembly of the type described above has the drawback that, during use with high-pressure fuel, internal pressure losses may occur. The object of the present invention is to provide an internal combustion engine fuel, preferably diesel fuel, feed pump assembly which is devoid of the drawbacks described above and which is simple and inexpensive to realize.

SUMMARY OF THE INVENTION

According to the present invention an internal combustion engine fuel, preferably diesel fuel, feed pump assembly is provided, the pump assembly comprising a pump body; at least one cylinder formed in the pump body and extending along an axis; a seat formed in the pump body, at one end of the cylinder; an intake valve for selectively controlling fuel feed into the cylinder, which is housed inside the seat and in turn comprises a valve body; and an annular seal extending around the axis and fitted inside the seat, between the valve body and the pump body; the pump assembly being characterized in that the valve body is positioned contacting the annular seal along a contact surface of the valve body and close to a surface portion adjacent to a radially inner peripheral edge of the seal; the valve body having an annular step along another surface portion adjacent to a radially outer peripheral edge of the seal.

Owing to the present invention, the contact surface area between the valve body and the seal is smaller than in the prior art; consequently the contact pressure between the valve body and the seal is greater than in the prior art. In this way the relative movements of the parts and consequently the wear and the loss of internal pressure are reduced.

According to a preferred embodiment, the annular step has a surface which is detached axially from the seal and which extends radially over at least a third of the surface of the seal.

According to another preferred embodiment, the axially detached surface is radially larger than the contact surface.

According to another preferred embodiment, the annular step is designed so that the pressure exerted by the contact surface on the seal is over 1600 bars, and preferably over 4950 bars.

According to another preferred embodiment, the pump body comprises an annular projection, which extends around the axis and contacts the seal along another surface portion adjacent to the radially inner peripheral edge of the seal.

According to another preferred embodiment, the intake valve comprises a shutter movable along the axis between an open position and a closed position respectively opening and closing an intake conduit for drawing fuel into the cylinder; and comprises a chamber formed in the valve body so as to communicate with the cylinder even when the shutter is in its closed position.

According to another preferred embodiment, the chamber is divided into a cylindrical portion and a frustoconical portion; and the shutter, when in its open position, extends at least partly outside the cylindrical portion of the chamber.

According to another preferred embodiment, the chamber is larger in diameter than the shutter.

According to another preferred embodiment, the chamber is formed coaxially with the axis of the shutter.

According to another preferred embodiment, the intake valve comprises a locking member for locking the valve body against the pump body by means of the seal arranged in between.

BRIEF DESCRIPTION OF THE DRAWINGS

The present invention will now be described with reference to the accompanying drawings which show a non-limiting example of embodiment thereof in which.

DETAILED DESCRIPTION

Figure 1:
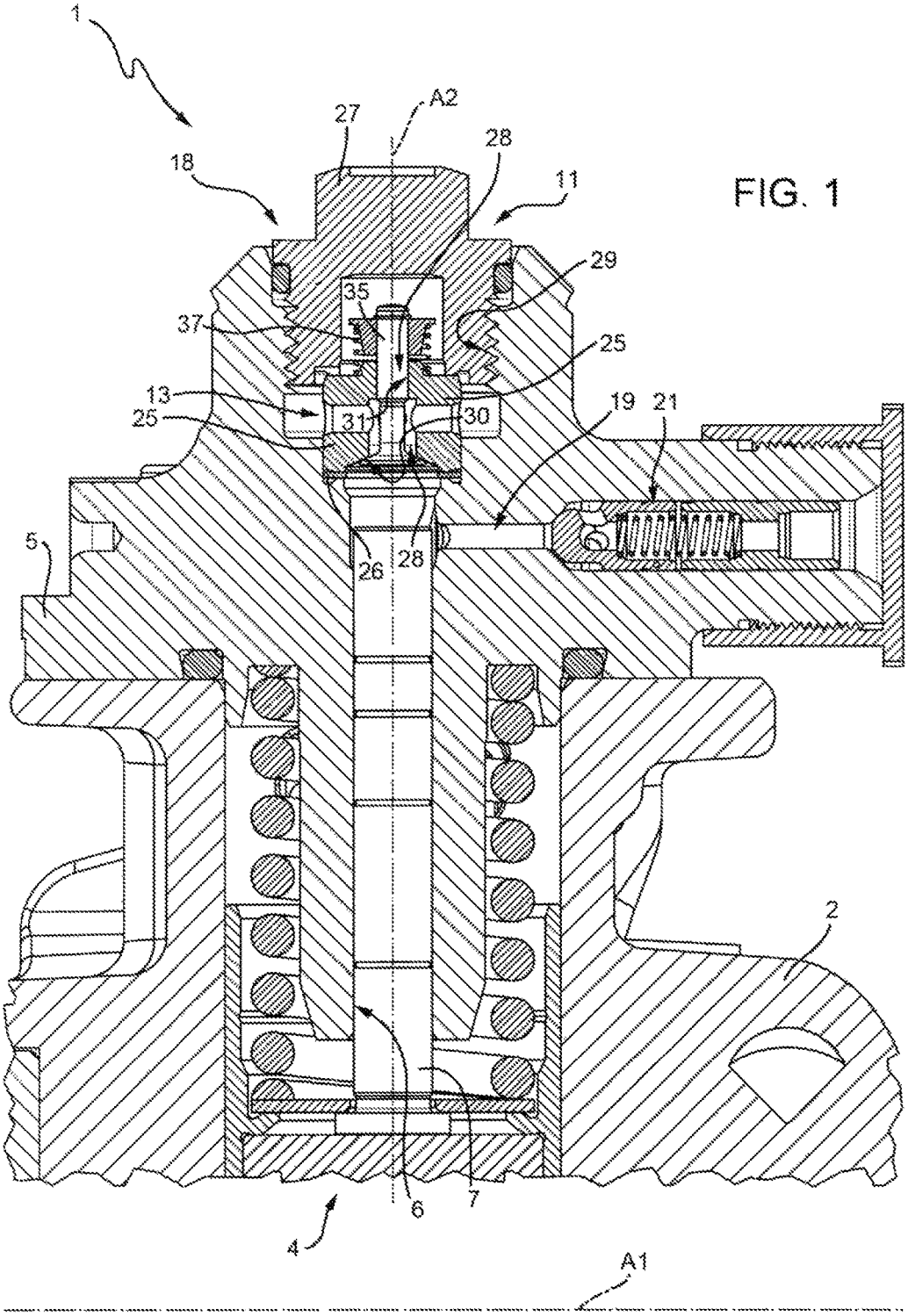
FIG. 1 is a cross-sectional view, with parts omitted for greater clarity, of the pump body designed according to the present invention.
Figure 2:
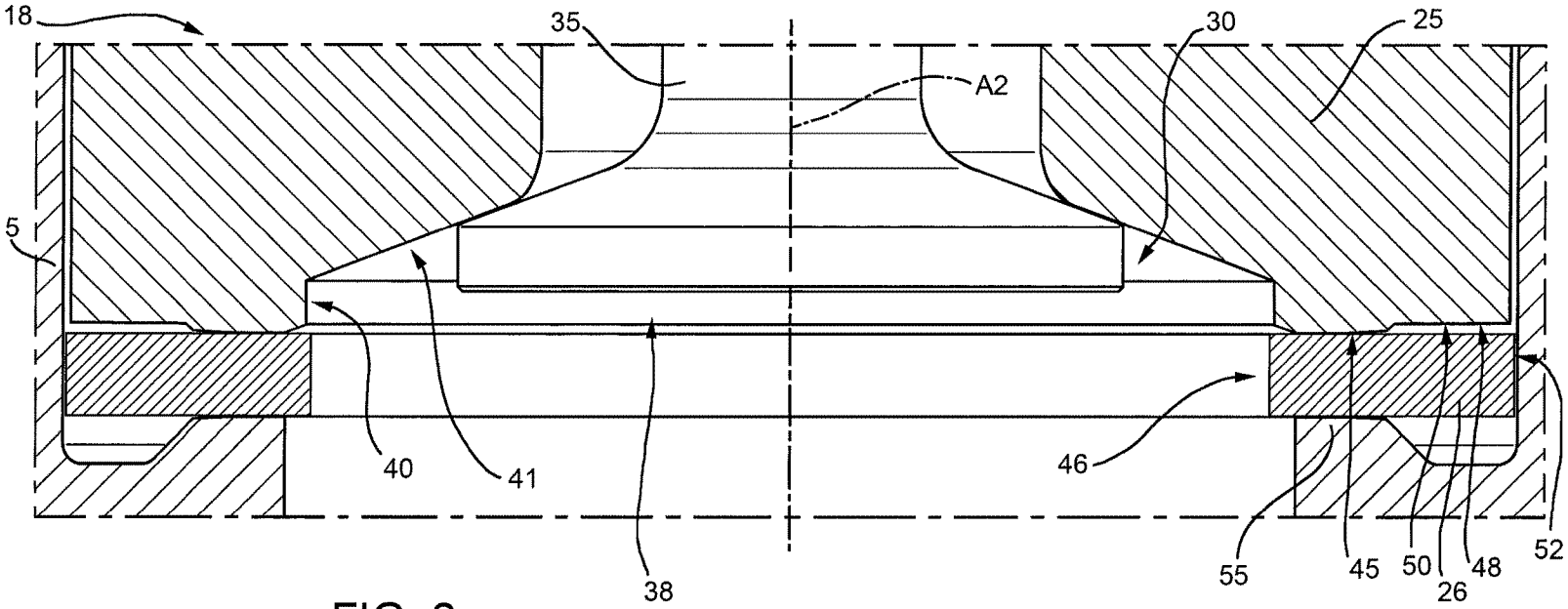
FIG. 2 is a view, on a larger scale, of a detail of the pump assembly shown in FIG. 1.

With reference to FIGS. 1 and 2, reference numeral 1 indicates, in its entirety, a pump assembly for feeding fuel, preferably diesel fuel, to an internal combustion engine (not shown).

The pump assembly 1 comprises a pump body 2 having a central hole (not shown) with a given longitudinal axis A1; a high-pressure pump 4 with pumping cylinders, designed to feed the fuel to the said internal combustion engine (not shown); and a gear pump, known and not shown, designed to feed the fuel to the pump 4.

The pump 4 comprises at least one head 5 having, formed inside it, a cylinder 6 which extends along an axis A2 lying in a plane which is transverse—preferably perpendicular—to the axis A1. Moreover, the cylinder 6 is slidably engaged by a respective pumping piston 7.

The head 5 has a central hole 11 which is formed through the head 5 coaxially with the axis A2 and communicated with the cylinder 6. The hole 11 defines a seat.

The seat houses inside it an intake valve 18 which is designed to control selectively feeding of the fuel into the said cylinder 6 along an intake conduit 13.

The head 5 also has a delivery conduit 19 which communicates with the cylinder 6 and houses inside it a delivery valve 21 of the known type designed to control selectively feeding of the fuel to the said internal combustion engine (not shown) along the delivery conduit 19.

The piston 7 is displaced by an actuating device (not shown in the accompanying figures) along the cylinder 6 with a reciprocating rectilinear movement comprising an intake stroke for drawing the fuel into the cylinder 6 and a compression stroke for compressing the fuel contained inside the said cylinder 6.

The intake valve 18 comprises a valve body 25 which extends around the axis A2, is arranged in contact with the head 5 by means of an annular seal 26 arranged in between and mounted perpendicularly with respect to the axis A2, and is axially locked inside the head 5 by a locking member 27, in particular a closing cover 27 which is screwed to a threaded surface 29 of the head 5 inside the seat.

The valve body 25 has a central hole 28 which extends coaxially with the axis A2 and comprises a widened portion 30 facing the cylinder 6 and a narrow portion 31 which is arranged on the opposite side of the cylinder 6 to the portion 30 and communicates with the widened portion 30 of the hole 28 and, therefore, with the said intake conduit 13.

The intake valve 18 further comprises a shutter 35 mounted through the hole 28 and movable along the axis A2 so as to be displaced between an open position (not shown) and a closed position (FIG. 2) of the intake conduit 13. The shutter is displaced into—and normally retained in—its closed position by a spring 37 arranged between the valve body 25 and the said shutter 35.

The portion 30 comprises, extending from the annular seal 26, a chamber 38 formed in the valve body 25 so as to communicate with the cylinder 6 even when the shutter 35 is arranged in its closed position. The chamber 38 is formed coaxially with the axis A2. The chamber 38 is divided into a cylindrical portion 40 and a frustoconical portion 41. The frustoconical portion 41 is designed so as to have a larger base adjacent to the annular seal 26 and a smaller base adjacent to the shutter 35.

The chamber 38 is larger in diameter than the shutter 35.

The shutter 35, when in its open position, extends at least partly outside of the cylindrical portion 40 of the chamber 38.

Furthermore, the valve body 25 is positioned contacting the seal 26 along a contact surface 45 of the valve body 25 and close to a surface portion adjacent to a radially inner peripheral edge 46 of the seal 26. The valve body 25 has an annular step 48 along another surface portion adjacent to a radially outer peripheral edge 52 of the seal 26.

The annular step 48 has a surface which is axially detached 50 from the seal 26 and which extends radially over at least a third of the surface of the seal 26. The axially detached surface 50 extends along a dimension perpendicular to the axis A2 greater than a dimension perpendicular to the axis A2 of the contact surface 45.

As already mentioned, the valve body 25 is axially locked inside the head 5 by the closing cover 27. The step 48 is configured so that, under the thrust of the cover 27, the pressure exerted by the contact surface 45 on the seal 26 is more than 1600 bars. In a preferred embodiment, the step 48 is configured so that, under the thrust of the cover 27, the pressure exerted by the contact surface 45 on the seal 26 is more than 4950 bars.

Figure 3:
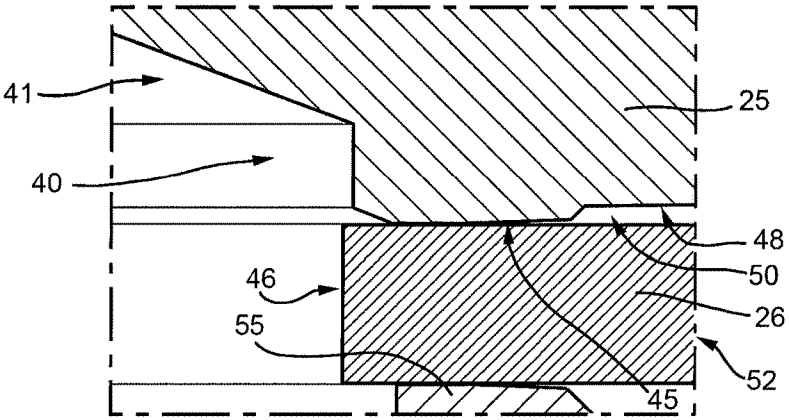
FIG. 3 is a view, on a larger scale, of a detail of the pump assembly shown in FIG. 2.

With reference to FIGS. 2 and 3, the pump body 2 comprises an annular projection 55 which extends around the axis A2 and is in contact with the seal 26 along another surface portion adjacent to the radially inner peripheral edge 46 of the seal 26.

In connection with that stated above it should be pointed out that, during the compression stroke of the piston 7, namely when the intake valve 18 is closed, the pressure of the fuel inside the cylinder 7 exerts both on the narrow portion 31 of the hole 11 and on the seal 26, as well as on the chamber 38 and therefore also on the valve body 25, a radial thrust substantially transverse to the axis A2.

Since the head 5, the valve body 25 and the seal 26 are all subject to the said radial thrust, the relative radial movements of the head 5 and the seal 26 and of the seal 26 and the valve body 25 are relatively small and consequently the wear of the head 5, the valve body 25 and the seal 26 is relatively limited.

Furthermore, since the valve body 25 is arranged in contact with the seal 26 along the contact surface 45 which is smaller than in the prior art, the contact pressure between the valve body 25 and the seal 26 is greater than in the prior art and consequently the relative movements of the valve body 25 and the seal 26 are relatively small. In this way the wear of the seal 26 and the valve body 25 along the contact surface 45 is reduced, as are the pressure losses, compared to the prior art.

It is furthermore clear that the present invention also covers embodiments which are not described in the detailed description and equivalent embodiments which fall within the scope of protection of the accompanying claims.

What is claimed is:

1. An internal combustion engine fuel feed pump assembly, the pump assembly (1) comprising a pump body (2) comprising a head (5), the head having therein a hole (11);

at least one cylinder (6) extending along an axis (A2), wherein the hole (11) is at one end of the cylinder (6);

a piston (7), the piston reciprocating within the cylinder and the pump body;

an intake valve (18) for selectively controlling fuel feed into the cylinder (6), wherein the intake valve is housed inside the hole (11) and comprises a valve body (25); and an annular seal (26) extending around the axis (A2) and fitted inside the hole (11) between the valve body (25) and the pump body (2);

the pump assembly (1) being characterized in that the valve body (25) is positioned contacting the annular seal (26) along a contact surface (45) of the valve body (25) and close to a surface portion adjacent to a radially inner peripheral edge (46) of the annular seal (26);

the valve body (25) having an annular step (48) along another surface portion adjacent to a radially outer peripheral edge (52) of the annular seal (26), wherein the annular step (48) has a surface (50) which is detached axially from the annular seal (26), wherein the axially detached surface (50) extends along a dimension perpendicular to the axis (A2) greater than a dimension perpendicular to the axis of the contact surface (45), wherein the pump assembly also comprises a chamber (38) having a cylindrical portion (40) and a frustoconical portion (41) respectively defined by a cylindrical wall of the valve body and a frustoconical wall of the valve body (25), the chamber (38) communicating with the cylinder (6), wherein the annular step (48) is adjacent the cylindrical wall of the valve body and the cylindrical wall of the valve body is between the annular seal (26) and the frustoconical wall of the valve body, wherein the intake valve (18) includes a shutter (35) movable along the axis (A2) between an open position and a closed position respectively opening and closing an intake conduit (13) for drawing the fuel into the cylinder (6), wherein, in the closed position, the shutter (35) contacts the frustoconical wall of the valve body, and wherein, in the open position, the shutter (35) extends at least partly outside the cylindrical portion (40) of the chamber (38) in a direction toward the annular seal (26).

2. The internal combustion engine fuel feed pump assembly according to claim 1, wherein the axially detached surface (50) extends radially over at least a third of the surface of the annular seal (26).

3. The internal combustion engine fuel feed pump assembly according to claim 1, wherein the cylindrical portion (40) and part of the frustoconical portion (41) of the chamber (38) are larger in diameter than the shutter (35).

4. The internal combustion engine fuel feed pump assembly according to claim 1, wherein the chamber (38) is formed coaxially with the axis (A2) of the shutter (35).

5. The internal combustion engine fuel feed pump assembly according to claim 1, wherein the intake valve (18) comprises a locking member (27) for locking the valve body (25) against the head (5) by means of the annular seal (26) arranged in between.

6. The internal combustion engine fuel feed pump assembly according to claim 1, wherein the head (5) comprises an annular projection (55), which extends around the axis (A2) and contacts the annular seal (26) along a bottom surface portion adjacent to the radially inner peripheral edge (46) of the annular seal (26).

7. The internal combustion engine fuel feed pump assembly according to claim 6, wherein the chamber (38) is formed in the valve body (25) so as to communicate with the cylinder (6) also when the shutter (35) is in the closed position.

8. The internal combustion engine fuel feed pump assembly according to claim 7, wherein the cylindrical portion (40) and part of the frustoconical portion (41) of the chamber (38) are larger in diameter than the shutter (35).

9. The internal combustion engine fuel feed pump assembly according to claim 8, wherein the chamber (38) is formed coaxially with the axis (A2) of the shutter (35).

10. The internal combustion engine fuel feed pump assembly according to claim 9, wherein the intake valve (18) comprises a locking member (27) for locking the valve body (25) against the head (5) by means of the annular seal (26) arranged in between.

* * * * *